US010415930B2

(12) United States Patent
Erdle

(10) Patent No.: US 10,415,930 B2
(45) Date of Patent: Sep. 17, 2019

(54) GUN SITE ASSEMBLY

(71) Applicant: Harrison Reed Inc., Fort Lauderdale, FL (US)

(72) Inventor: Jesse A. Erdle, Pittsford, NY (US)

(73) Assignee: Harrison Reed Inc., Fort Lauderdale, FL (US)

( * ) Notice: Subject to any disclaimer, the term of this patent is extended or adjusted under 35 U.S.C. 154(b) by 0 days.

(21) Appl. No.: 15/433,715

(22) Filed: Feb. 15, 2017

(65) Prior Publication Data

US 2017/0321992 A1 Nov. 9, 2017

Related U.S. Application Data

(60) Provisional application No. 62/332,739, filed on May 6, 2016.

(51) Int. Cl.

| | |
|---|---|
| ***F41G 1/34*** | (2006.01) |
| ***F41G 1/02*** | (2006.01) |
| ***F41G 1/10*** | (2006.01) |

(52) U.S. Cl.

CPC ..... *F41G 1/345* (2013.01); *F41G 1/02* (2013.01); *F41G 1/10* (2013.01)

(58) Field of Classification Search

CPC ... F41G 1/345; F41G 1/02; F41G 1/10; F41G 1/32; F41A 17/063; F41C 27/00

USPC ..... 42/145, 32

See application file for complete search history.

(56) References Cited

U.S. PATENT DOCUMENTS

| | | | | |
|---|---|---|---|---|
| 5,065,519 | A | 11/1991 | Bindon | |
| 8,579,450 | B2 | 11/2013 | Profos | |
| 9,488,318 | B2 | 11/2016 | Kind et al. | |
| 9,572,273 | B2 | 2/2017 | Blunier et al. | |
| 2012/0151817 | A1* | 6/2012 | Howe | F41G 1/345 42/132 |
| 2013/0185984 | A1 | 7/2013 | Glimpse et al. | |
| 2014/0109460 | A1 | 4/2014 | Howe et al. | |
| 2015/0153136 | A1 | 6/2015 | Howe et al. | |
| 2015/0208539 | A1 | 7/2015 | Blunier et al. | |
| 2016/0238343 | A1 | 8/2016 | Jakob et al. | |
| 2018/0010886 | A1* | 1/2018 | Kind | F41G 1/345 |

FOREIGN PATENT DOCUMENTS

| | | | | |
|---|---|---|---|---|
| AT | 516018 | B1 | 2/2016 | |
| EP | 2476992 | A2 | 7/2012 | |
| WO | 2011067291 | A1 | 6/2011 | |
| WO | 2016124686 | A1 | 8/2016 | |
| WO | WO-2018035279 | A1 * | 2/2018 | G21F 5/015 |

OTHER PUBLICATIONS

PCT/US2017/031315; filed May 5, 2017; International Search Report dated Aug. 17, 2017; 3 pages.

* cited by examiner

*Primary Examiner* — John Cooper
(74) *Attorney, Agent, or Firm* — Barclay Damon, LLP

(57) ABSTRACT

A gun sight assembly includes a housing with an inner bore and a sleeve. The sleeve has an axial cavity in which a luminescent source may be housed. The sleeve is press-fit into the bore such that complementary engagement features of the bore and the sleeve engage each other to lock the sleeve in place within the bore. In one version, the sleeve can be first received within an adapter configured for press-fit into the bore of the gun sight blank.

18 Claims, 9 Drawing Sheets

GUN SITE ASSEMBLY

CROSS REFERENCE TO RELATED APPLICATION

Pursuant to relevant portions of 35 U.S.C. § 119 and 37 CFR § 1.53, this application claims the benefit and priority of U.S. Patent Application No. 62/332,739, filed on May 6, 2016. The entire contents of this application is hereby incorporated by reference.

TECHNICAL FIELD

This application is directed generally to the field of gun sights and more specifically to a gun sight assembly having a luminescent source housed within a sleeve that is configured for snap-fit engagement with a gun sight blank.

BACKGROUND

Gun use for hunting and target shooting is increasing in popularity. A critical component of a gun is a gun sight. Gun sights are vital for assisting the gun user in aiming the gun properly to avoid a stray shot. Gun sights are typically positioned at the front of the barrel or at a position away from the user, and the rear of the barrel or at a position near the user. The user aims at a target by aligning the front and rear gun sights relative to a target of interest.

Many guns employ a high visibility plug in their gun sights. These high visibility plugs are brightly colored and directly inserted into the gun sight blank. The high visibility plugs provide contrast and therefore the benefit of easy visualization under many types of conditions. These plugs are friction fitted within the gun sight blank with little or no adhesive. Such a fit requires very precise and consequently very expensive machining of the gun sight blanks, as well as the plugs, in order to ensure a proper and reliable fit. Should the tolerances of the machined gun sight blank be slightly off, or the adhesive not properly applied, the high visibility plug will not be installed properly and the finished gun sight will not be accurate. Moreover, these plugs often become loose over time from repeated firing of the gun and subsequently fall out of the gun sight blank.

To achieve the same contrasting effect, other conventionally known gun sights employ a luminescent fixture in place of a high visibility plug. The luminescent fixture may be comprised of a fluorescent material or other source of illumination, such as an incandescent bulb. Materials, such as tritium gas, are popular materials to use in gun sights as they are highly visible and do not require any external power source. Typically, a source of tritium gas is placed within a glass tube with a phosphor layer being disposed therebetween. However, these luminescent fixtures are placed deep within the gun sight blank with an intermediate piece of material being installed between the fixture and the eye of the user. This installation decreases the visibility, and consequently the overall effectiveness of the luminescent fixture.

The foregoing background describes some, but not necessarily all, of the problems, disadvantages and shortcomings related to current gun sight assemblies. There is a general and pervasive need in the field to provide a gun sight assembly that is reliable, not difficult to manufacture and install in a rifle or other firearm, does not impact the overall functionality of the firearm, and is cost effective.

BRIEF DESCRIPTION

According to one aspect, a gun sight assembly comprises a gun sight blank with an inner bore defined by an interior surface. The inner bore extends between a forward end and a rearward end of the gun sight blank and the interior surface includes one or more engagement features. The gun sight assembly further includes a resilient sleeve which has an opening at a first end. The resilient sleeve comprises an axial cavity defined by an inner surface, an outer surface which has one or more complimentary engagement features configured to engage the one or more engagement features of the interior surface of the gun sight blank, and an end flange disposed at the first end of the resilient sleeve. The end flange has an inner annular surface which defines an end opening and the end opening has a diameter that is less than a diameter of the axial cavity. A luminescent source is configured to be retained within the resilient sleeve.

According to another aspect, the gun sight assembly includes a blank made from a structural material. The blank has a first end and a second end and further comprises an axial bore defined by an interior surface. The axial bore extends at least partially through the blank and the interior surface has at least one engagement feature formed thereon. At least one insert made from a resilient material is included in the gun sight assembly. The at least one insert has an exterior surface which includes one or more complimentary engagement features that are configured to engage the one or more formed engagement features of the axial bore of the blank when the at least one insert is inserted into the bore. The complementary engagement features are sized and configured to create a snap-fit coupling between the blank and the at least one insert.

According to yet another aspect, a method of assembling a gun sight the method is provided which includes providing a gun sight blank which has an interior surface defining an inner bore that extends between an open end and a tapered end. The interior surface has at least one engagement feature and the open end includes an annular shoulder. Providing a sleeve that has an inner surface which defines an axial cavity that extends between a first end and a second end. The first end includes a flange that defines an opening that has a diameter that is less than a diameter of the axial cavity. The sleeve has an exterior surface that includes at least one complimentary engagement feature. A luminescent source is inserted into the axial cavity of the sleeve from the second end such that the luminescent source is housed within the sleeve and contacts the flange of the sleeve. The sleeve containing the luminescent source is then inserted into the inner bore until the at least one engagement feature of the interior surface of the gun sight blank and the at least one complimentary engagement feature of the exterior surface of the sleeve are in snap-fit engagement.

Positioning the luminescent source proximate the front end of the gun sight blank increases the visibility of the luminescent source. Furthermore, the snap-fit engagement of the gun sight blank with the sleeve or the insert increases the ease and accuracy of assembly. In addition, the snap-fit engagement configuration allows for increased machining/manufacturing tolerances which leads to decreased manufacturing costs. The gun sight of the present disclosure also greatly decreases the amount of time required to manufacture a set of gun sights. Moreover, the snap-fit engagement of the gun sight blank with the sleeve or the insert completely eliminates the need for glue or adhesive, such as UV Curing Glue, 2 Part Epoxies, and Silicon Type Glue. As was previously mentioned, current gun sight assemblies use glue or other adhesives to secure components inside the gun sight blank. The use of glue makes assembling the gun sight assembly an extremely slow process that requires additional clean-up procedures and processing of the gun sight assembly in order to achieve the desired finished product. The gun sight assembly of the current disclosure also ensures that the insert and any contents of the insert are properly centered within the inner bore of the gun sight blank. Moreover, the disclosed gun sight assembly and corresponding method of assembling reduces the number of operations and tools required to manufacture a standard set of gun sights/night sights. In addition to the overall savings in manufacturing cost, the snap-fit engagement allows the user to remove the sleeve or insert and replace it should there be damage to the luminescent source or the sleeve or insert.

Additional features and advantages of the present disclosure are described in, and will be apparent from, the accompanying drawings as well as the following Detailed Description.

This brief description is intended only to provide a brief overview of subject matter disclosed herein according to one or more illustrative embodiments, and does not serve as a guide to define or limit the scope of the invention. This brief description is provided to introduce an illustrative selection of concepts in a simplified form that are further described below in the Detailed Description.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a gun sight assembly. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "forward", "rearward", "interior", "exterior", "front", "back", "inner", "external", "top", "bottom", and the like are not intended to limit these concepts, except where so specifically indicated. With regard to the drawings, their purpose is to depict salient features of the inventive gun sight assembly and are not specifically provided to scale.

Figure 1:
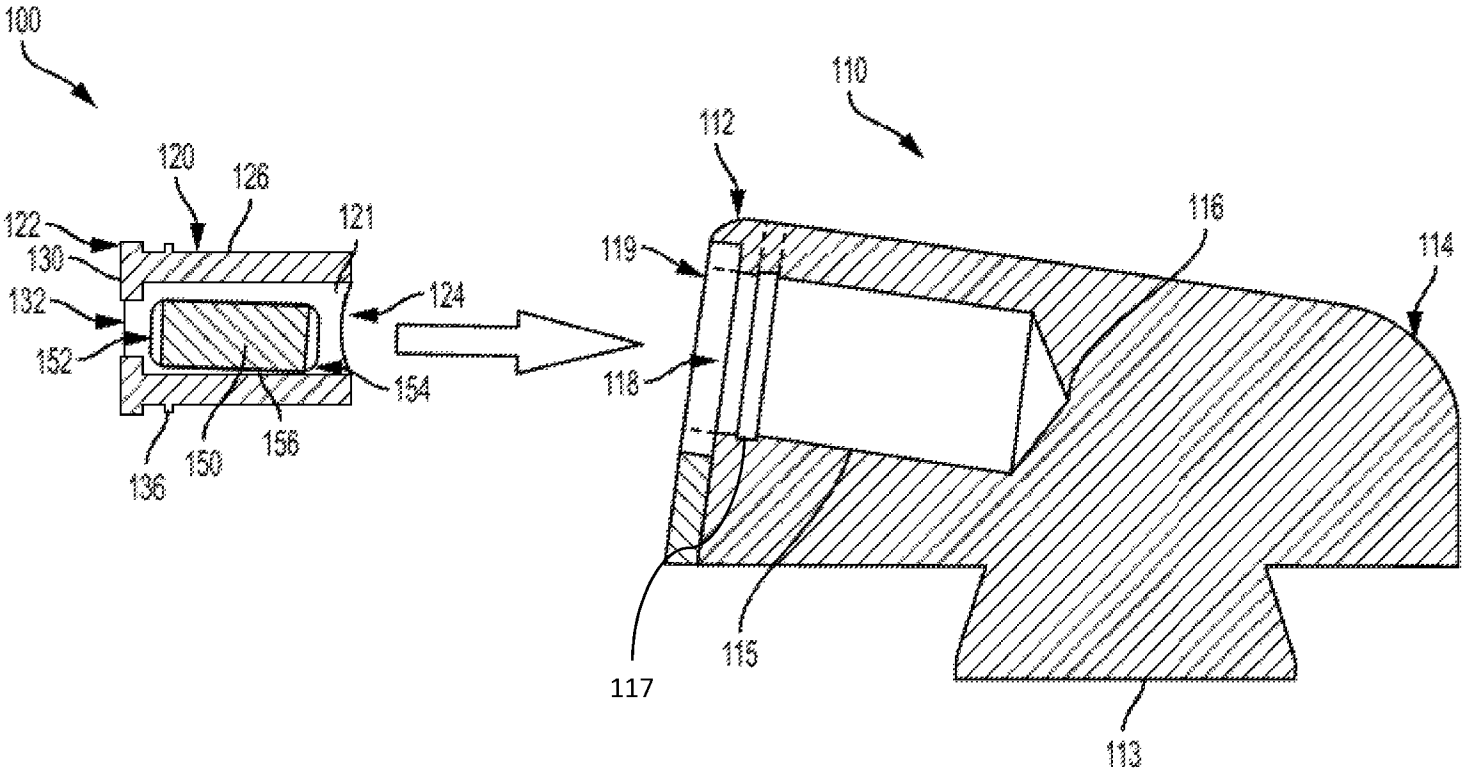
FIG. 1 is an exploded cross section view of a gun sight assembly made in accordance with a first embodiment.
Figure 4:
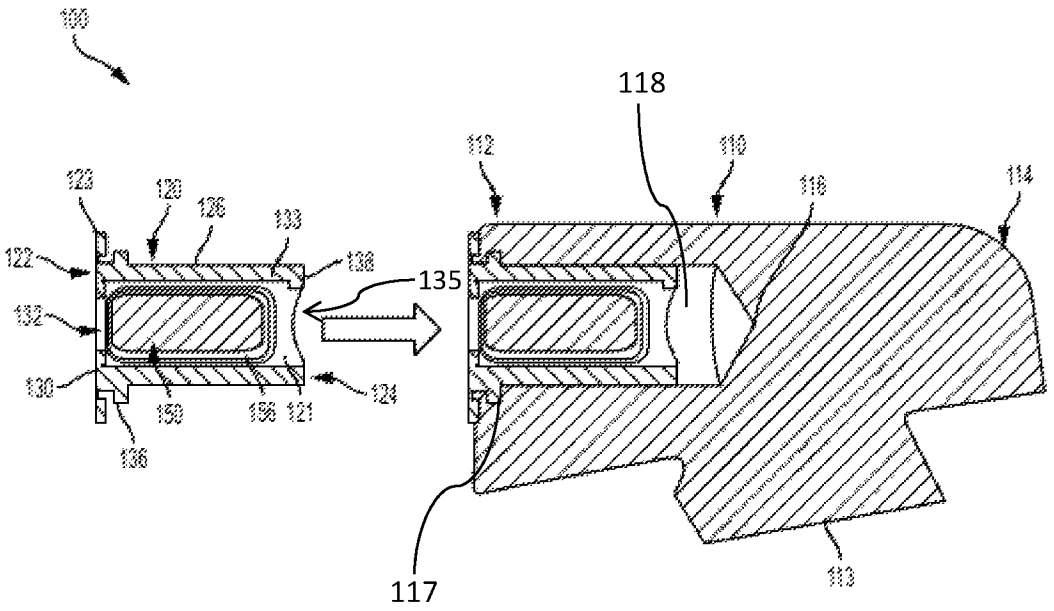
FIG. 4 is an exploded cross section view of the gun sight assemblies of FIGS. 1-3, showing the engagement of a sleeve within the gun sight blank.

According to a first embodiment depicted in FIGS. 1-4, a gun sight assembly 100 includes a gun sight blank 110, a sleeve 120 or insert, and a luminescent source 150 (the latter shown only in FIGS. 1 and 4). The herein depicted gun sight assembly is a front gun sight, though it will be understood that other suitable version can be similarly configured as a rear gun sight. The gun sight blank 110 according to this embodiment is defined by a housing made from suitable structural material such as plastic, rubber, or metal, and having a forward end 112, a rearward end 114, and an attachment area 113 disposed at a lower part of the housing that is configured for coupling the gun sight blank 110 to a portion of a firearm (not shown). An inner bore 118 or cavity is milled or otherwise formed in the forward end 112 of the blank 110. The inner bore 118 is defined by an inner continuous annular wall 115 that may extend from the forward end 112 intermediately toward the rearward end 114 of the gun sight blank 110. In other embodiments, the gun sight blank 110 may include more than one inner bore 318 or cavity. In the embodiment shown in FIGS. 1-4, the inner bore 118 is bounded by a tapered end surface 116, the tapered end surface 116 being defined herein by a conical configuration. Alternatively, the inner bore 118 may extend completely through the gun sight blank 110 from the forward end 112 and through the rearward end 114. As shown, the diameter of the inner bore 118 is substantially constant with the exception of the tapered end surface 116, an annular recess 119 formed at the end opening of the inner bore 118, and one or more engagement features or detent structures 117 that are formed on the inner continuous annular wall 115, as discussed in greater detail below. The number and location of the engagement features may vary.

Figure 2:
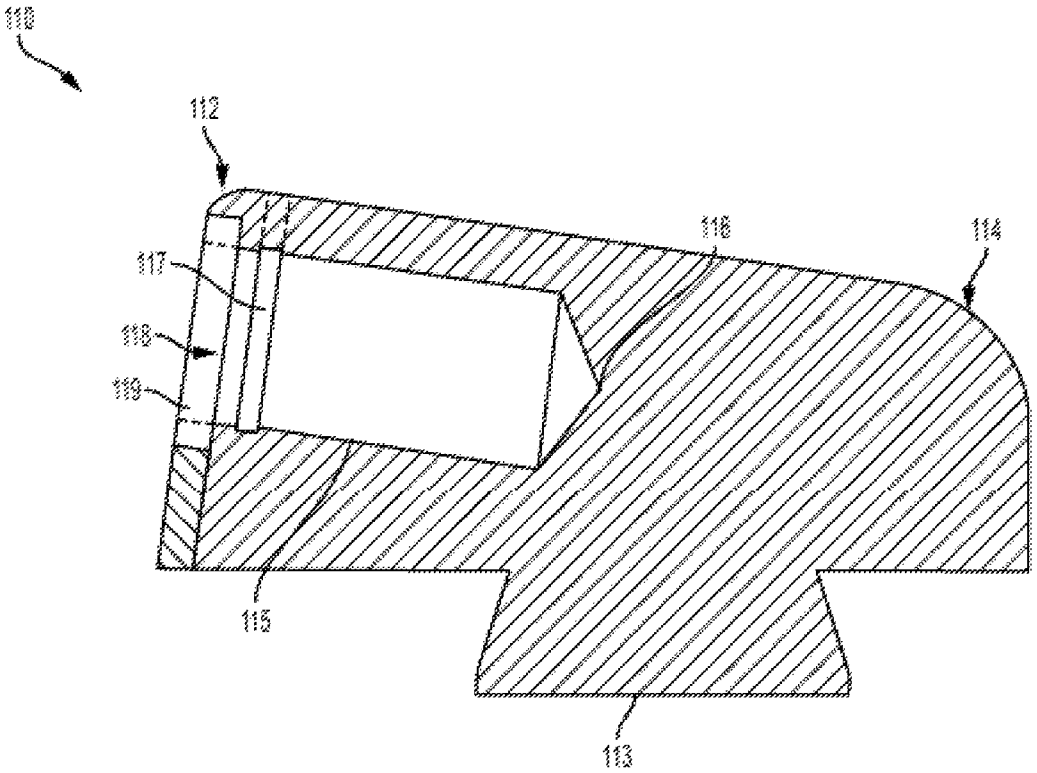
FIG. 2 is a sectioned side elevational view of the gun sight blank of the assembly of FIG. 1.
Figure 3:
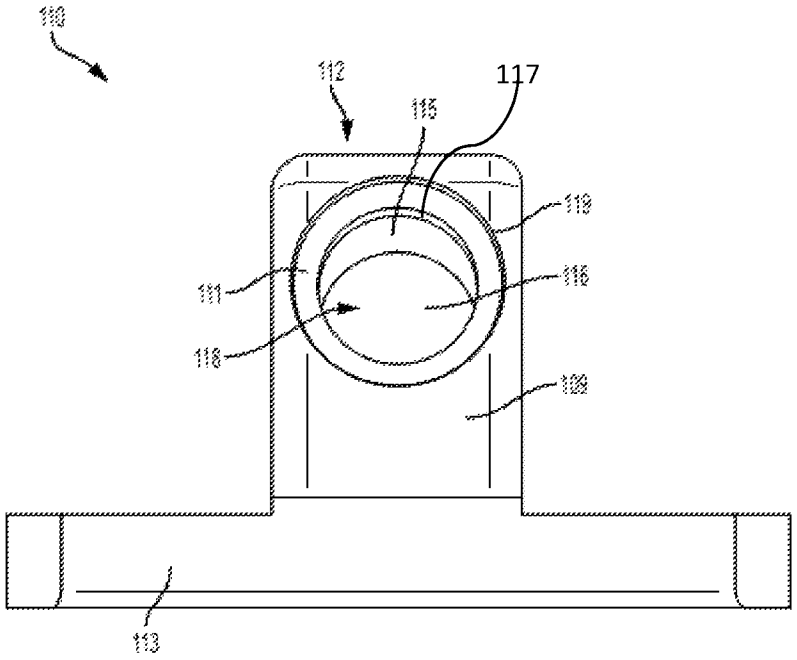
FIG. 3 is a front isometric view of the gun sight blank of FIG. 2.

The annular recess 119 defines a diameter that is larger than the diameter of the inner bore 118. The junction of the annular recess 119 with the inner bore 118 forms a shoulder 111 (FIG. 3) which faces the forward end 112 of the gun sight blank 110. The shoulder 111 acts as a stop and prevents over insertion of the sleeve 120, as discussed herein. Referring to FIG. 2, the inner continuous annular wall 115 may include one or more annular detents, detent structures, grooves, threads, ridges, depressions, protrusions or other similar features for engagement with the sleeve 120 and more particularly to provide snap-fitting engagement therewith. As shown most particularly in FIG. 2, the inner continuous annular wall 115 of the inner bore 118 can include at least one annular groove 117 disposed in relation to the forward end of the gun sight blank 110. As noted, the number of annular grooves 117 can be suitably modified. The gun sight blank 110 and its associated features including the inner bore 118, the inner continuous annular wall 115, and the engagement features 117 (e.g., annular grooves) may be formed by any known machining process or molding process including metal injection molding (MIM), or any combination thereof.

Referring to FIGS. 1 and 4, the sleeve 120 according to this embodiment is defined by a substantially cylindrical body that includes a front end 122, an opposing back end 124, and an exterior surface 126. The interior of the sleeve 120 is essentially hollow and is defined by an axial cavity 121 extending from the front end 122 to the back end 124 of the sleeve 120. More specifically and according to this embodiment, the sleeve 120 is further defined by a forward end flange 130 at the front end 122, as well as an optional rearward end flange 138 (shown only in FIG. 4) formed at the back end 124, the axial cavity 121 of the sleeve 120 further having an interior surface 133 (FIG. 4). Each of the forward and rearward end flanges 130, 138 (FIG. 4) according to these embodiments are annular and include inner radial surfaces that form openings 132, 135 (FIG. 4) at the respective ends of the sleeve 120, each of the openings 132, 135 having respective diameters which are smaller than the inner diameter of the formed axial cavity 121.

Still referring to FIGS. 1 and 4, the exterior surface 126 of the sleeve 120 may include one or more annular ridges 136 or other suitable engagement features that cooperate with complementary features formed on the inner continuous annular wall 115 of the inner bore 118, such as the annular groove 117. As shown in the embodiments of FIGS. 1 and 4, the number and location of the engagement features 136 may vary.

Still referring to FIGS. 1 and 4, a luminescent source 150 is retained within the formed axial cavity 121 of the sleeve 120. The luminescent source 150 may include any suitable material or structure configured to increase the visibility of the gun sight assembly 100, such as a vial of tritium gas, a fiber optic light pipe, or a glow-in-the-dark material. In the embodiment shown, the luminescent source 150 is a vial of tritium gas having a first end 152 and an opposing second end 154. The sleeve 120, including the axial cavity 121 and the forward and rearward end flanges 130, 138, are suitably dimensioned to at least partially surround the luminescent source 150 while leaving at least one end of the luminescent source 150 exposed so that may be visible through the opening 132. As shown, the movement of the luminescent source 150 within the sleeve 120 is constrained in the axial direction by the forward end flange 130 and the optional rearward end flange 138. Positioning the luminescent source 150 close to the opening 132 increases the visibility of the luminescent source 150 and therefore, the gun sight assembly 100. In another embodiment, for example, the luminescent source 150 may be axially constrained by the forward end flange 130 and the tapered end surface 116. In an embodiment, the luminescent source 150 may have limited movement in the axial and/or radial directions. As noted, the luminescent source 150 is at least partially enclosed in a protective envelope such as the vial 156, or other material which provides a cushion to help protect the luminescent source 150 from impact or shock loads.

In another embodiment, the sleeve 120 or insert does not contain a separate luminescent source 150, but rather is formed from a material having luminescent properties, for example a plastic with luminescent powder. In another embodiment, the insert may be hollow as in the previously described embodiments, or may be a solid piece of material having an exterior surface with one or more annular ridges or other engagement features which cooperate with complementary engagement features on the inner continuous annular wall 115 of the inner bore 118 of the gun sight blank 110.

Figure 5B:
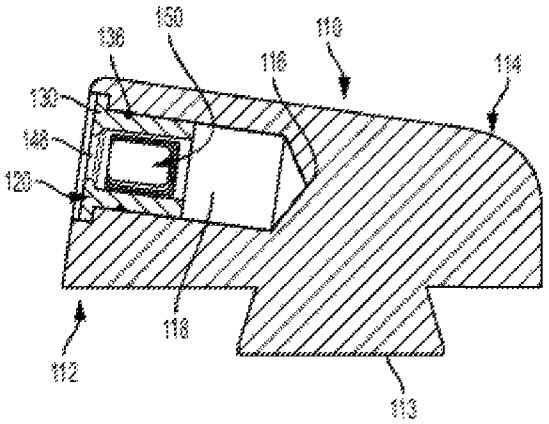
FIG. 5B is a side elevational view of the gun sight assembly of FIG. 5A.
Figure 5A:
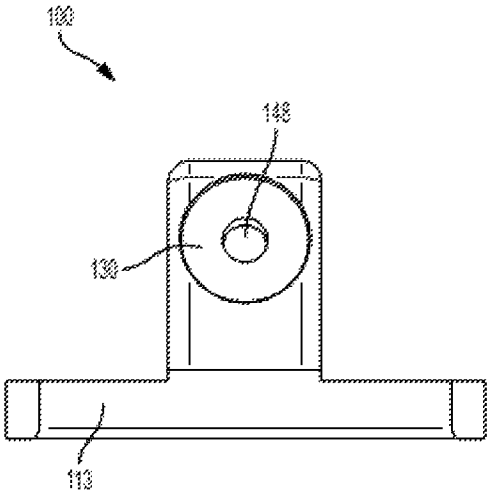
FIG. 5A is a front isometric view of an embodiment of a gun sight assembly made in accordance with a second embodiment.

Referring to an alternative embodiment shown in FIGS. 5A and 5B, the sleeve 120 may have a plurality of engagement features in the form of an annular ridge 136 formed on the exterior surface 126 of the sleeve 120 configured to engage a complimentary plurality annular grooves 117 formed on the inner continuous annular wall 115 of the gun sight blank 110. As shown, the forward end flange 130 is recessed below the forward face 109 of the gun sight blank 110. A lens 148 or other form of optically transparent cover may be fitted over the opening 132 to protect the contents of the sleeve and/or magnify or focus the photons being emitted from the luminescent material (e.g., tritium gas). The lens 148 or optically transparent cover may extend along a different plane such as in the case of a convex or a concave lens. In an embodiment, the lens may axially restrain the luminescent source or the insert.

For purposes of assembly and referring to the embodiments of FIGS. 1-4, 5A and 5B, the luminescent source 150 can be inserted into the back end 124 of the sleeve 120. In another embodiment, the sleeve 120 may have one or more axial slots (not shown) positioned along the length of the sleeve 120 and extending at least partially between the front end 122 and the back end 124 of the sleeve 120 such that the luminescent source 150 can be inserted through the one or more axial slots. The sleeve 120 retaining the luminescent source 150 is inserted into the inner bore 118. As shown in FIG. 4, the sleeve 120 does not traverse the entire length of the inner bore 118, however in other embodiments, the sleeve 120 can extend over the entire length of the inner bore 118. As shown, the one or more engagement features 136 formed on the exterior surface 126 of the sleeve 120 cooperate with the one or more engagement features 117 of the inner continuous annular wall 115 to secure the sleeve 120 in a press or snap-fit engagement within the gun sight blank 110. Once assembled, the forward end flange 130 of the sleeve 120 is received within the annular recess 119 and is restricted from further axial movement upon engagement with the shoulder 111 of the gun sight blank 110. In another embodiment, the flange is not received within an annular recess and is coplanar with the forward end 112 of the gun sight blank 110. When assembled and as shown in FIGS. 4 and 5B, the outermost surface of the forward end flange 130 of the sleeve 120 is substantially flush with the forward end 112 of the gun sight blank 110. In another embodiment, the forward end flange 130 of the sleeve 120 is not substantially flush with the forward end 112 of the gun sight blank 110 upon assembly. In an embodiment, the forward end flange 130 and/or the entire sleeve 120 may be a different color and/or material than that of the gun sight blank 110 to increase visibility. In an embodiment, the sleeve 120 is made of plastic or any material of sufficient rigidity and resiliency such that the sides of the sleeve 120 may compress slightly during insertion into the gun sight blank 110 and resiliently decompress to engage the complimentary features of the exterior surface 126 of the sleeve 120 and the inner continuous annular wall 115 of the gun sight blank 110.

Figure 6:
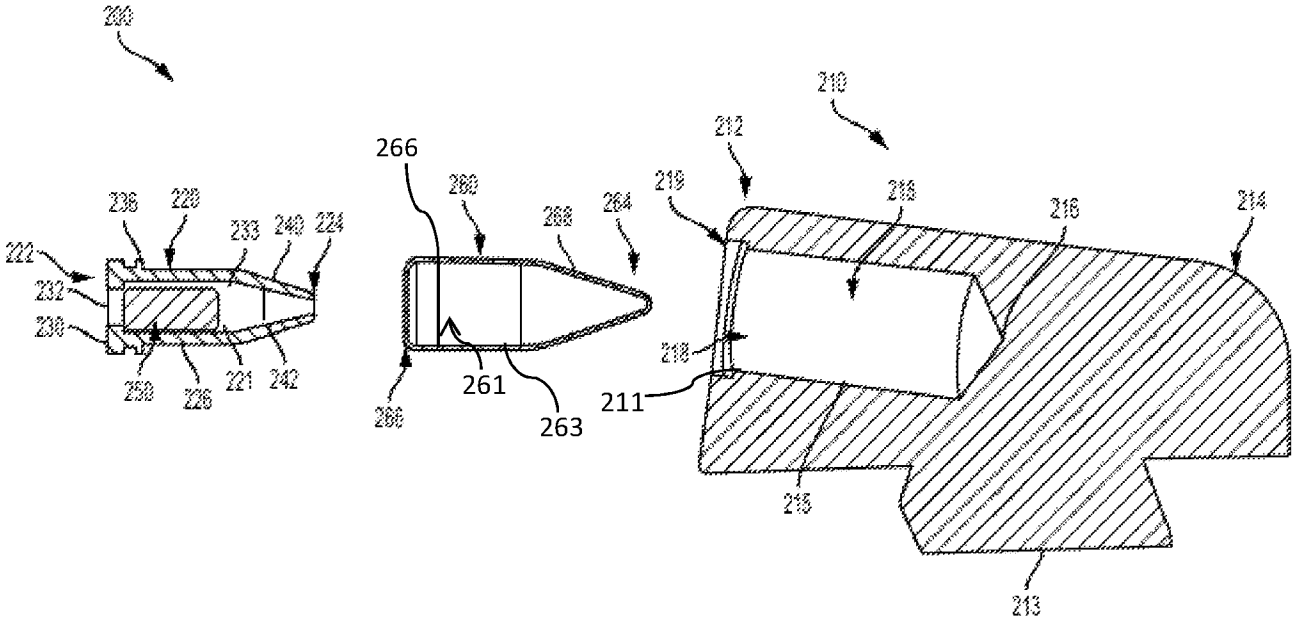
FIG. 6 is an exploded section view of a gun sight assembly made in accordance with a third embodiment.

With reference to FIG. 6, a gun sight assembly 200 made in accordance with yet another embodiment includes a gun sight blank 210, a sleeve 220, a luminescent source 250, and an adapter 260. As shown, the gun sight assembly 200 is a front gun sight assembly. However, and as previously discussed, other embodiments may include a version configured for use as a rear gun sight. Similar to the foregoing, the gun sight blank 210 according to this embodiment is defined by a housing or blank body having a forward end 212, an opposing rearward end 214, and an attachment area 213 disposed at a lower part of the gun sight blank 210 for coupling the gun sight blank 210 to a portion of a firearm (not shown). The gun sight blank 210 further includes an inner bore 218 that extends from the forward end 212 toward the rearward end 214 of the gun sight blank 210 and is further defined by an interior surface or interior wall 215. In other embodiments, the gun sight blank 210 may have more than one inner bore 218. As shown, the inner bore 218 may extend intermediately toward the rearward end 214 and be bounded at one end by a tapered end surface 216. However, in some embodiments, the inner bore 218 traverses completely through the gun sight blank 210 from the forward end 212 to the rearward end 214. In the embodiment shown in FIG. 6, the tapered end surface 216 is conical or substantially conical. Other configurations can be contemplated. An annular recess 219 is milled or otherwise formed at the opening of the inner bore 218 proximate the forward end 212 of the gun sight blank 210, the annular recess 219 defining an annular shoulder 211 in which the diameter of the annular recess 219 is greater than the diameter of the remainder of the inner bore 218. The annular shoulder 211 acts as a stop to prevent over insertion of the sleeve 220. In some embodiments, the interior wall 215 of the inner bore 218 may include one or more annular detents, detent features, grooves, or threads acting as complementary engagement features. The gun sight blank 210 and its associated features including the inner bore 218, interior wall 215, and engagement features may be formed by any known machining process, molding process including MIM, or any combination thereof. The engagement features can also be machined onto a preexisting gun sight blank.

As shown, the sleeve 220 is defined by a housing having opposing front and back ends 222, 224. According to the embodiment shown in FIG. 6, the sleeve 220 is defined by a substantially elongated cylindrical configuration from the front end 222 over the majority of the axial extent of the sleeve 220 and the back end 224 is defined by an inwardly tapering conical or frusto-conical configuration, shown as a tapered portion 240. The sleeve 220 is further defined by an exterior surface 226 and a hollow interior that defines an axial cavity 221 extending between the front end 222 and the back end 224. In some embodiments, the back end 224 may include a threaded portion or additional annular ridges 242 on the exterior surface 226. To that end, the exterior surface 226 of the sleeve 220 may include one or more annular ridges 236 or other surface features. The number and location of the annular ridges 236 or surface features may vary. As noted, the axial cavity 221 extends entirely through the sleeve 220 from the front end 222 to the back end 224. In another embodiment, the axial cavity 221 does not extend entirely from the front end 222 to the back end 224 of the sleeve 220.

As shown in FIG. 6, the axial cavity 221 is defined by an interior wall 233 and bounded by an end flange 230 at the forward end and a tapered portion 240 at the back end 224. Optionally and in other embodiments, the sleeve 220 may have a rearward lip, stop member, or retention member (not shown) instead of the tapered portion 240. In yet another embodiment, the sleeve 220 may have one or more axial slots (not shown) positioned along the length of the sleeve 220 and extending at least partially between the front end 222 and the back end 224 of the sleeve 220 such that a luminescent source 250 can be inserted through the one or more axial slots.

The end flange 230 is defined by an annular inner surface that forms an end opening 232 that extends into the axial cavity 221. In an embodiment, the end flange 230 and/or the entire sleeve 220 may be a different color and/or material than that of the remainder of the sleeve 220. In an embodiment, the sleeve 220 is made of plastic or any material of sufficient rigidity and resiliency such that the sides of the sleeve 220 may compress slightly during insertion into the gun sight blank 210 and resiliently decompress to engage the complimentary features of the exterior surface 226 with the engagement features of the interior wall 215.

According to this embodiment, the adapter 260 is an intermediate structure that is sized and configured to receive the sleeve 220, the adapter 260 being defined by a complementary shaped structure having respective forward and rearward ends 266, 264. The adapter 260 is defined by a hollow cavity 261 having an interior wall 263 that may include one or more engagement features such as threads, channels, grooves, ridges, and the like that are configured to engage with complementary engagement features on the exterior surface 226 of the sleeve 220. As shown, the adapter 260 has a tapered portion 268 at the rearward end 264 which may be conformed in shape to the tapered portion 240 of the sleeve 220 and aligned therewith axially. Still referring to FIG. 6, in another embodiment, the rearward end 264 of the adapter 260 may include at least one surface feature, such as an annular ridge 242, used to positively engage, grab, or otherwise secure the adapter 260 to the interior wall 215 and/or the tapered end surface 216 of the inner bore 218 of the gun sight blank 210. The number and position of the engagement features on the sleeve 220 and/or adapter 260 may vary. The adapter 260 is of particular use when the thickness of the interior wall 215 precludes the machining of threads or other features into it. In some embodiments, the tapered portion 268 of the adapter 260 may be threaded in order to provide positive engagement with the gun sight blank 210.

The luminescent source 250 may be a container of luminescent gas, such as a vial of tritium gas, or may be any other suitable material or structure configured to increase the visibility of the gun sight such as a fiber optic light pipe. According to this embodiment, the luminescent source 250 is housed within the sleeve 220 and more specifically within the axial cavity 221. The sleeve 220 is dimensioned to surround the luminescent source 250, while leaving at least one end exposed so that it may be visible through the defined end opening 232. As shown, the outer diameter of the luminescent source 250 is larger than the diameter of either the end opening 232 or the tapered portion 240 such that movement of the luminescent source 250 is constrained in the axial direction. In an embodiment, the luminescent source 250 may have limited movement in the axial and/or radial directions. In another embodiment, the luminescent source 250 is partially enclosed in a protective envelope, such as a vial, or another material which provides a cushion to help protect the luminescent source 250 from impact or shock loads. A lens (not shown), similar to that shown in FIG. 5B, or other form of optically transparent cover may be fitted over the end opening 232 to protect the contents of the sleeve and/or magnify or focus the photons being emitted from the luminescent material (e.g., tritium gas). The lens or optically transparent cover may extend along the same plane as the end flange 230. However in other embodiments, the lens or cover may extend along a different plane such as in the case of a convex or concave lens.

In another embodiment, the sleeve 220 or insert does not contain a separate luminescent source 250, but rather is formed from a material having luminescent properties; for example, a plastic with luminescent powder. In an embodiment, the insert may be hollow as in the previously described embodiments, or may be a solid piece of material having an exterior surface with one or more annular ridges 236 or other engagement features which cooperate with complementary engagement features 266 formed on the interior wall 263 of the adapter 260. In still another embodiment, the adapter 260 itself may be formed from a material having luminescent properties such that a separate sleeve 220 and luminescent source 250 are not required.

In terms of assembly, the adapter 260 according to this embodiment is fitted into the inner bore 218 of the gun sight blank 210 and the luminescent source 250 is inserted into an axial slot (not shown) of the sleeve 220. In another embodiment, the sleeve 220 may not have a tapered portion 240 and instead may have a rearward end flange configured to retain the luminescent source and constrain its movement in the axial direction. The engagement features of the sleeve 220 interact with the complimentary engagement features 266 of the adapter 260 to facilitate a press or snap-fit engagement. In a further embodiment, the tapered portion 268 of the adapter 260 may comprise a plurality of resilient or expandable members (not shown) that are configured to expand or extent outward into engagement with the interior wall 215 of the inner bore 218 as the sleeve 220 is fitted into the hollow interior of the adapter 260 when the adapter 260 is inserted into the inner bore 218. The fitting of the adapter 260 into the inner bore 218 according to the foregoing embodiments may occur mechanically and without need for an adhesive.

Figure 7:
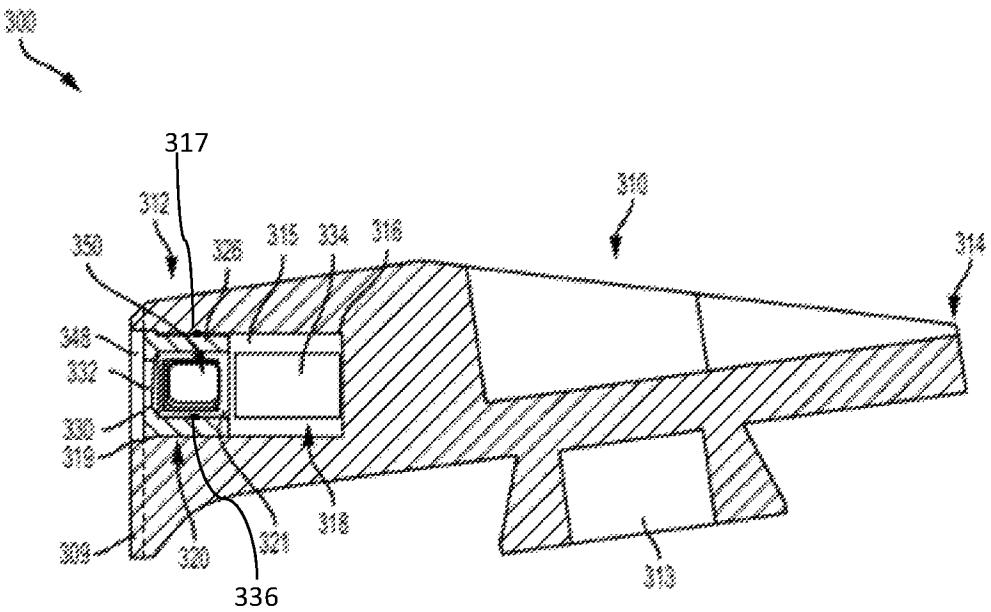
FIG. 7 is a sectioned view of a gun sight assembly made in accordance with a fourth embodiment.
Figure 8:
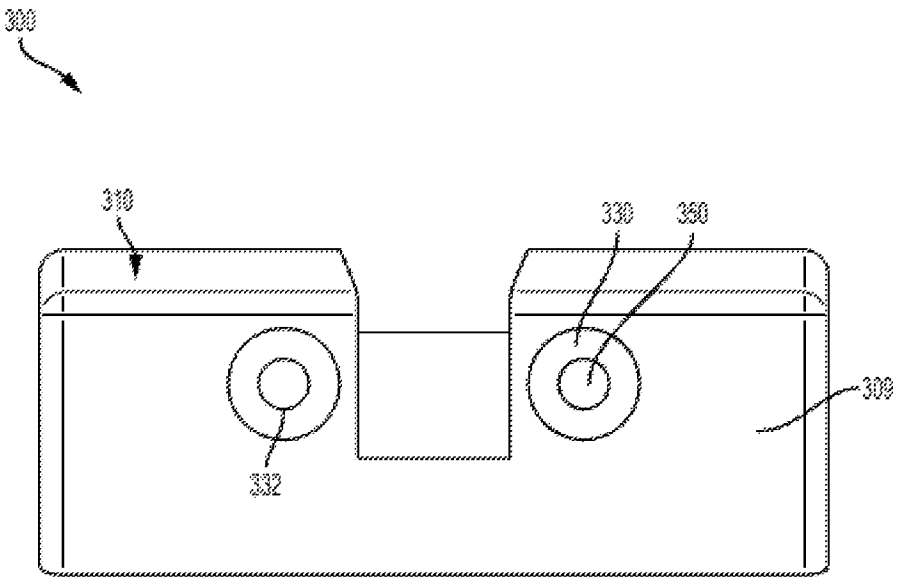
FIG. 8 is a front view of the gun sight assembly of FIG. 7.

Referring to FIGS. 7 and 8, another embodiment of a gun sight assembly 300 includes a gun sight blank 310, a sleeve 320, and a luminescent source 350. As shown, the gun sight assembly 300 is a rear gun sight, however other embodiments may comprise a version for use as a front gun sight. The gun sight blank 310 according to this embodiment is defined by a blank housing or body having a forward end 312, an opposing rearward end 314, and an attachment area 313 disposed at a lower portion of the blank housing for coupling the gun sight blank 310 to a portion of a firearm (not shown). As shown, the gun sight blank 310 includes an inner bore 318 that may extend from the forward end 312 toward the rearward end 314 of the gun sight blank 310, the inner bore 318 being defined by an inner annular wall 315. As shown in FIG. 8, the gun sight blank 310 two inner bores 318 that are configured to accept a corresponding number of sleeves 330.

Each inner bore 318 may be bounded at one end by an end surface 316. As shown, the end surface 316 is substantially perpendicular to the inner annular wall 315. However, in other embodiments, the end surface 316 may not be substantially perpendicular to the inner annular wall 315. In another embodiment, each inner bore 318 may extend completely through the gun sight blank 310 from the forward end 312 through the rearward end 314. An annular recess 319 is formed at the opening of the inner bore 318 proximate the forward end 312 of the gun sight blank 310. As shown in FIG. 7, the diameter of the formed annular recess 319 is greater than the diameter of the inner bore 318. The annular recess 319 also defines a forward facing shoulder 311 similar to that of FIG. 3, which faces the forward end 312 of the gun sight blank 310. As discussed herein, the forward facing shoulder 311 acts as a stop to prevent over insertion of the sleeve 320. Similar to the embodiment of FIG. 2, the inner annular wall 315 of the gun sight blank 310 may include one or more annular detents 317, detent features, grooves, or other suitable engagement features. The gun sight blank 310 and its features including the inner bore 318, the inner annular wall 315, and the engagement features may be formed by any known machining process, molding process MIM, or any combination thereof. As shown, the gun sight blank 310 is a single unitary component, however in other embodiments the gun sight blank 310 may not be a single unitary component. The engagement features 317 may be machined onto a preexisting gun sight blank.

As shown in FIG. 7, the sleeve 320 is at least partially disposed within the inner bore 318 and has a front end that includes a forward end flange 330 that includes an inner annular surface forming an opening 332 to the remainder of the inner bore 318. According to this embodiment, the sleeve 320 does not traverse the entire length of the inner bore 318. However, in other embodiments, the sleeve 320 may extend the entire length of the inner bore 318. Referring to the embodiment of FIG. 7, a plug 334 may be inserted between the end surface 316 of the inner bore 318 and the inserted sleeve 320 to provide added support for the sleeve 320 and its contents. The plug 334 can vary in size and may substantially fill the inner bore 318 between the end surface 316 and the sleeve 320, thus allowing the same sleeve 320 to be used with inner bores 318 of varying length. The sleeve 320 is defined by a hollow interior that defines an axial cavity 321 extending through the length of the sleeve 320 from the front end 322 to an opposite back end 324. An exterior surface 326 of the sleeve 320 may include one or more annular ridges or other suitable engagement features 336 which cooperate with complementary engagement features 317 provided on the inner annular wall 315 of the inner bore 318 to enable a press or snap-fit engagement. The axial cavity 321 is aligned with the opening 332 defined by the forward end flange 330 and may be bounded at an opposite end by the plug 334. The opening 332 has a diameter that is smaller than that of the axial cavity 321. In an embodiment, the forward end flange 330 and/or the entire sleeve 320 may be a different color and/or material than that of the remainder of the sleeve 320. In an embodiment, the sleeve 320 is made of plastic or any material of sufficient rigidity and resiliency such that the sides of the sleeve 320 may compress slightly during insertion into the gun sight blank 310 and resiliently decompress to engage the complimentary features of the exterior surface 326 and the inner annular wall 315. As shown in the assembled position of FIG. 7, the forward end flange 330 may be flush with and extend along the same plane as the forward facing side 309 of the gun sight blank 310.

As in the prior discussed versions, the luminescent source 350 includes luminescent material. The luminescent material used may be a luminescent gas, such as tritium, a liquid, solid, semi-solid or any suitable material or may be defined by a structure configured to increase the visibility of the gun sight, such as a fiber optic light pipe. In an embodiment, the luminescent material may be at least partially surrounded by a protective envelope which may be housed within the sleeve 320. The sleeve 320 is dimensioned to surround the luminescent source 350 while leaving one end of the luminescent source 350 exposed, enabling a portion of the luminescent source 350 to be visible through the opening 332. As shown, movement of the luminescent source 350 is axially constrained within the sleeve 320 by the forward end flange 330 and an end of the plug 334. In an embodiment, the sleeve 320 may include an inner diameter that is smaller than that of the luminescent source 350 such that the movement of the luminescent source 350 is constrained by the forward end flange 330 at one end and by the rearward facing lip at the opposite end. In an embodiment, the luminescent source 350 may have limited movement in the axial and/or radial directions. A lens 348 or other optically transparent cover may be fitted over the opening 332 to protect the contents of the sleeve 320 and/or magnify or focus the photons being emitted from the luminescent source 350 (e.g., the tritium gas). As shown in FIG. 7, the lens 348 may extend along the same plane as the forward end flange 330, however in other embodiments, the lens 348 may extend along a different plane such as in the case of a convex or concave lens.

In another embodiment, the sleeve 320 or insert does not contain a separate luminescent source 350, but rather is formed from a material having luminescent properties; for example a plastic made with luminescent powder. In an embodiment, the insert may be hollow as in the previously described embodiments, or may be a solid piece of material having an exterior surface with one or more engagement features which cooperate with complementary engagement features provided on the inner annular wall 315 of the inner bore 318.

As shown in FIG. 8, the gun sight blank 310 may be configured to house more than one sleeve 320 as in the case of a rear gun sight blank. According to the depicted version and for example, sleeves 320 are disposed within respective bores 318 (FIG. 7) that are formed on opposing lateral sides of the gun sight blank 310 relative to a center portion and wherein each housed sleeve 320 contains a luminescent source 350. Upon assembly, the forward end flange 330 of each sleeve 320 may be flush or substantially flush with the forward facing side 309 with the gun sight blank 310 and may be comprised of a different type and/or color of material than that of the gun sight blank 310. In other embodiments, at least one of the forward end flange 330 of the sleeves 320 may not be flush with the forward facing side 309 of the gun sight blank 310.

Figure 9B:
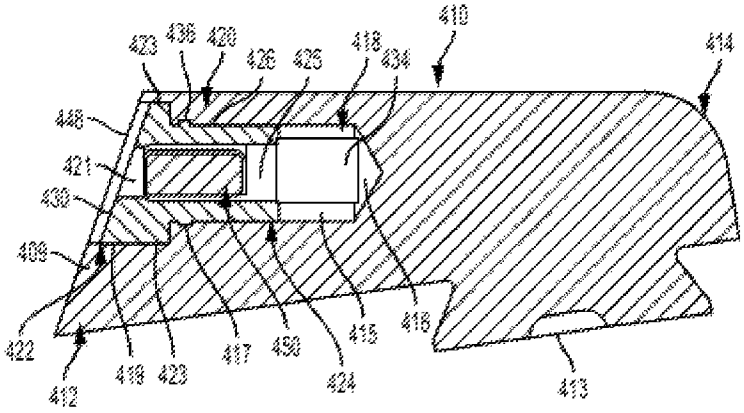
FIG. 9B is a sectioned view of the gun sight assembly of FIG. 9A.
Figure 9A:
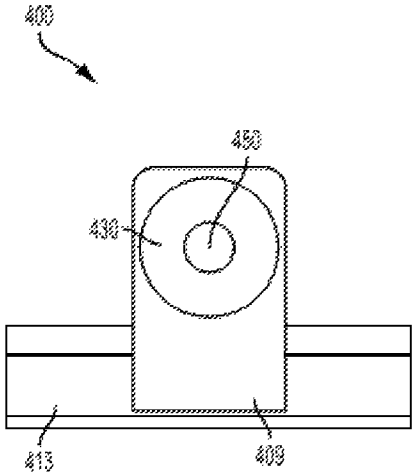
FIG. 9A is a front view of a gun sight assembly in accordance with a fifth embodiment.

FIGS. 9A and 9B show yet another embodiment of a gun sight assembly 400 having a gun sight blank 410, a sleeve 420, and a luminescent source 450. As shown, the gun sight 400 is a front gun sight assembly, however other embodiments may be defined for use as a rear gun sight. Referring to FIG. 9B, the gun sight blank 410 is defined by a blank body or housing having a forward end 412, an opposed rearward end 414, and an attachment portion 413 formed at a lower portion of the blank body for coupling the gun sight blank 410 to a portion of a firearm (not shown). According to this embodiment, the gun sight blank 410 has a forward facing surface 409 that is angled relative to the plane of the gun sight blank 410 such that the forward facing surface 409 is not perpendicular to the plane of the gun sight blank 410. An inner bore 418 is defined by an annular inner wall 415 that extends between the forward end 412 and the rearward end 414. In another embodiment, the gun sight blank 410 may have more than one inner bore 418. As shown in FIG. 9B, the inner bore 418 is bounded at one end by a tapered end surface 416, however in some embodiments, the inner bore 418 traverses completely through the gun sight blank 410. As shown, the tapered end surface 416 has a frusto-conical configuration, however in other embodiments, the tapered end surface may have other configurations. According to this embodiment, an annular recess 419 is formed in the opening of the inner bore 418. The annular recess 419 includes a variable axial depth over its circumference and extends to an annular shoulder 411 formed within the inner bore 418. The annular shoulder 411 acts as a stop to prevent over insertion of the sleeve 420. The annular inner wall 415 may include one or more annular detents, detent features, grooves, threads, or other suitable engagement features 417. As shown according to this specific embodiment, the annular inner wall 415 of the inner bore 418 includes at least one engagement feature 417. According to the embodiment and as shown in FIG. 9B, the at least one engagement feature is an annular groove 417. The gun sight blank 410 and its associated features including for example, the inner bore 418, the annular inner wall 415, and the engagement features may be formed by any known machining process, molding process including MIM, or any combination thereof.

Referring to FIG. 9B, the sleeve 420 is disposed for retention within at least a portion of the inner bore 418. As shown, the sleeve 420 does not traverse the entire length of the inner bore 418, however in other embodiments, the sleeve 420 extends the entire length of the inner bore 418. In some embodiments, a plug 434 may be inserted between the tapered end surface 416 and the sleeve 420 to provide added support for the sleeve 420 and its contents. The plug 434 can vary in size, and may substantially fill the inner bore 418 between the tapered end surface 416 and the sleeve 420 thus allowing the same sleeve 420 to be used with inner bores 418 of varying length. As shown in this embodiment, the sleeve 420 has a front end 422 and an opposing back end 424 with an axial cavity 421 extending between the ends 422, 424. The sleeve 420 also includes an exterior surface 426 and the axial cavity 421 includes an interior surface 425. The exterior surface 426 of the sleeve 420 may include one or more complimentary engagement features 436 which engage the one or more engagement features 417 of the annular inner wall 415 in a press or snap-fit engagement upon insertion of the sleeve 420 into the inner bore 418.

As shown in FIG. 9B, the sleeve 420 further includes an outer lip 430 having an exterior annular wall 423. The outer lip 430 extends radially outward of the exterior surface 426 such that the outer diameter of the exterior annular wall 423 is greater than the diameter of the exterior surface 426. The outer lip 430 is angled with respect to the annular shoulder 411 such that the outer lip sits flush and on the same plane as the forward facing surface 409. The outer lip 430 is a flange defined by an inner annular surface that defines an opening 432 that is aligned with the axial cavity 421. In an embodiment, the flange 430 and/or the entire sleeve 420 may be a different color and/or material than that of the gun sight blank 410. In an embodiment, the sleeve 420 is made of plastic or any material of sufficient rigidity and resiliency such that the sides of the sleeve 420 may compress slightly during insertion into the gun sight blank 410 and resiliently decompress to engage the complimentary features of the exterior surface 426 and the annular inner wall 415. In some embodiments, the sleeve 420 may include a rearward facing lip opposite the flange 430. In some embodiments, the inner diameter of the flange 430 and the rearward facing lip is less than the diameter of the inner bore 418.

The luminescent source 450 includes one or more luminescent materials. The luminescent material used may be a luminescent gas, such as tritium, a liquid, solid, semi-solid or any suitable material or structure intended to increase the visibility of the gun sight such as a fiber optic light pipe. In an embodiment, the luminescent material may be at least partially surrounded by a protective envelope which may be housed within the sleeve 420. The sleeve 420 is dimensioned to surround the luminescent source 450 while leaving at least one end of the luminescent source 450 exposed so that a portion of the luminescent source 450 is visible through the end opening 432. As shown, movement of the luminescent source 450 is constrained in the axial direction by the outer lip 430 and by one end of the plug 434. In an embodiment, the sleeve 420 may have a rearward facing lip such that the movement of the luminescent source 450 is constrained by the flange 430 at one end and by the rearward facing lip at the opposite end. In an embodiment, the luminescent source 450 may have limited movement in the axial and/or radial directions. A lens 448 or other transparent cover may be fitted over the end opening 432 to protect the contents of the sleeve and/or magnify or focus the photons being emitted from the luminescent source 450. As shown in FIG. 9B, the lens 448 may extend along the same plane as the flange 430, however in other embodiments, the lens 448 may extend along a different plane such as in the case of a convex or concave lens.

In another embodiment, the sleeve 420 or insert does not contain a separate luminescent source 450, but rather is formed from a material having luminescent properties, for example a plastic made with luminescent powder. In an embodiment, the insert may be hollow as in the previously described embodiments, or may be a solid piece of material having an exterior surface with one or more engagement features which cooperate with complementary engagement features on the annular inner wall 415 of the inner bore 418.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

PARTS LIST FOR FIGS. 1-9(B)

100 gun sight assembly
110 gun sight blank
111 shoulder
112 forward end, blank
113 attachment area, blank
114 rearward end, blank
115 inner annular wall
116 tapered end surface
117 annular groove
118 inner bore
119 annular recess
120 sleeve
121 axial cavity
122 front end, sleeve
124 back end, sleeve
126 exterior surface
130 forward end flange
132 opening, forward end
133 interior surface
135 opening, rearward end
136 annular ridge
138 rearward end flange
148 lens
150 luminescent source
152 first end, luminescent source
154 second end, luminescent source
156 protective envelope
200 gun sight assembly
210 gun sight blank
211 annular shoulder
212 forward end, blank
213 attachment area, blank
214 rearward end, blank
215 interior wall
216 tapered end surface
218 inner bore
219 annular recess
220 sleeve
221 axial cavity
222 front end, sleeve
224 back end, sleeve
226 exterior surface
230 end flange
232 end opening
236 annular ridge
240 tapered portion
242 surface features
250 luminescent source
260 adapter
261 hollow cavity
263 interior wall
264 rearward end
266 forward end
268 tapered portion
300 gun sight assembly
309 forward facing side
310 gun sight blank
311 forward facing shoulder
312 forward end, blank
313 attachment area, blank
314 rearward end, blank
315 inner annular wall
316 end surface
318 inner bore
319 annular recess
320 sleeve
321 axial cavity
326 exterior surface
330 forward end flange
332 opening
334 plug
348 lens
350 luminescent source
400 gun sight assembly
409 forward facing surface
410 gun sight blank
411 annular shoulder
412 forward end, blank
413 attachment portion
414 rearward end
415 annular inner wall
416 tapered end surface
417 annular groove
418 inner bore
419 recessed portion
420 sleeve
421 axial cavity
422 front end, sleeve
423 exterior annular wall
424 back end, sleeve
425 interior surface
426 exterior surface
430 flange
432 end opening
434 plug
448 lens
450 luminescent source Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A gun sight assembly comprising:

a gun sight blank molded with an inner bore defined by an interior surface, the inner bore extending between a forward end and a rearward end of the gun sight blank, the interior surface including one or more engagement features that are molded as part of the interior surface;

a resilient sleeve having an opening at a first end, the resilient sleeve comprising;

an axial cavity defined by an inner surface, an outer surface including one or more complimentary engagement features configured to engage the one or more engagement features of the interior surface of the gun sight blank when inserted into the inner bore and to secure the resilient sleeve within the inner bore, and an end flange disposed at the first end of the resilient sleeve, the end flange having an inner annular surface which defines an end opening, the end opening having a diameter that is less than a diameter of the axial cavity; and a luminescent source configured to be retained within the resilient sleeve.

2. The gun sight assembly of claim 1, wherein the end flange of the resilient sleeve is a different color than the resilient sleeve.

3. The gun sight assembly of claim 1, wherein the resilient sleeve has a stop member at a second end.

4. The gun sight assembly of claim 1, wherein the luminescent source is a vial of tritium gas.

5. The gun sight assembly of claim 1, wherein the gun sight blank further comprises an annular recess configured to accept the end flange of the resilient sleeve.

6. The gun sight assembly of claim 1, wherein one of the one or more engagement features of the gun sight blank and the one or more complimentary engagement features of the resilient sleeve is at least one annular groove, and wherein one of the one or more engagement features of the gun sight blank and the one or more complimentary engagement features of the resilient sleeve is at least one circumferential ridge.

7. The gun sight assembly of claim 5, wherein a junction between the annular recess and the axial cavity forms a shoulder, the shoulder being sized and configured to act as a stop surface to prevent over insertion of the resilient sleeve.

8. A gun sight assembly comprising;

a blank molded from a structural moldable material, the blank having a first end and an opposing second end and further comprising, an axial bore defined by an interior surface and extending at least partially through the blank, the interior surface having at least one engagement feature, wherein the blank and the at least one engagement feature are integrally molded as a single unitary component;

at least one insert made from a resilient material, the at least one insert having an exterior surface including one or more complimentary engagement features that are configured to engage the one or more formed engagement features of the axial bore of the blank when the at least one insert is inserted into the axial bore, and wherein the first end of the blank further comprises one or more annular recesses, and wherein the insert further comprises an integrally molded flange configured to occupy the one or more annular recesses.

9. The gun sight assembly of claim 8, wherein the at least one insert has luminescent properties.

10. The gun sight assembly of claim 8, wherein a junction between the one or more annular recesses and the cavity forms a shoulder, the shoulder being sized and configured to act as a stop surface to prevent over insertion of the luminescent insert.

11. The gun sight assembly of claim 8, wherein the one or more engagement feature of the at least one interior surface of the blank is an annular ridge.

12. The gun sight assembly of claim 11, wherein the one or more complimentary engagement feature of the one or more inserts is an annular groove.

13. A method of assembling a gun sight, the method comprising:

providing a gun sight blank formed by metal injection molding;

forming the gun sight blank with an interior surface defining an inner bore extending between an open end and an opposing tapered end, wherein the interior surface is formed with at least one integral engagement feature;

providing a sleeve having an inner surface defining an axial cavity extending between a first end and an opposing second end, the first end including a flange having an opening with a diameter that is less than a diameter of the axial cavity, wherein the sleeve has an exterior surface that includes at least one complimentary engagement feature;

inserting a luminescent source into the axial cavity of the sleeve from the second end such that the luminescent source is housed within the sleeve and contacts the flange of the sleeve; and inserting the sleeve containing the luminescent source into the inner bore until the at least one engagement feature of the interior surface of the gun sight blank and the at least one complimentary engagement feature of the exterior surface of the sleeve are in snap-fit engagement.

14. The method of claim 13, wherein the flange of the sleeve is a different color than the exterior surface of the sleeve.

15. The method of claim 13, wherein the gun sight blank further includes an annular recess positioned at the open end of the inner bore.

16. The method of claim 13, wherein the open end including an annular shoulder that is sized and configured to create a stop surface in order to prevent over insertion of the sleeve.

17. The method of claim 13, wherein the luminescent source is axially confined by the flange and the tapered end of the gun sight blank and radially confined by the inner surface of the sleeve.

18. The method of claim 13, further including a lens disposed over at least part of the flange.

* * * * *